US010535289B2

(12) United States Patent
Sakurai et al.

(10) Patent No.: US 10,535,289 B2
(45) Date of Patent: Jan. 14, 2020

(54) DISPLAY DEVICE, DISPLAY METHOD, RECORDING MEDIUM, AND TELEVISION RECEIVER

(71) Applicant: Sharp Kabushiki Kaisha, Sakai, Osaka (JP)

(72) Inventors: Ryoji Sakurai, Sakai (JP); Shigeki Taniguchi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 15/752,601

(22) PCT Filed: Dec. 27, 2016

(86) PCT No.: PCT/JP2016/088970
§ 371 (c)(1),
(2) Date: Feb. 14, 2018

(87) PCT Pub. No.: WO2017/126309
PCT Pub. Date: Jul. 27, 2017

(65) Prior Publication Data

US 2018/0247581 A1 Aug. 30, 2018

(30) Foreign Application Priority Data

Jan. 18, 2016 (JP) ..... 2016-007471

(51) Int. Cl.
*G09G 3/34* (2006.01)
*G09G 3/36* (2006.01)
*G09G 3/20* (2006.01)

(52) U.S. Cl.
CPC ..... *G09G 3/20* (2013.01); *G09G 3/34* (2013.01); *G09G 3/3426* (2013.01); *G09G 3/36* (2013.01);
(Continued)

(58) Field of Classification Search
CPC ..... G09G 3/3426; G09G 3/36; G09G 2320/0626; G09G 2340/16; G09G 2360/16
See application file for complete search history.

(56) References Cited

U.S. PATENT DOCUMENTS

2008/0123747 A1* 5/2008 Lee ..... H04N 19/20 375/240.16
2009/0322796 A1 12/2009 Yoshida
(Continued)

FOREIGN PATENT DOCUMENTS

CN 104285250 A 1/2015
JP 2011-221079 A 11/2011
(Continued)

OTHER PUBLICATIONS

Official Communication issued in International Patent Application No. PCT/JP2016/088970, dated Apr. 4, 2017.

*Primary Examiner* — Grace Q Li
(74) *Attorney, Agent, or Firm* — Keating & Bennett, LLP

(57) ABSTRACT

A technique of displaying an image at adequate luminance with a configuration simpler than a configuration in related art is disclosed. A display device (1) includes a display unit (40) that is configured such that luminance of an image to be displayed is adjustable on a per area basis of multiple areas, an image processing unit (32) that generates an output image by modifying a signal level of an input image in a current frame by referencing process information concerning a preceding frame generated by a process information generation unit (34) in the preceding frame, and a display control unit (36) that determines maximum luminance, adjusts luminance on a per area basis of the multiple areas, and displays the output image at the adjusted luminance.

5 Claims, 7 Drawing Sheets

(52) U.S. Cl.
CPC ..... *G09G 2320/0271* (2013.01); *G09G 2320/0626* (2013.01); *G09G 2330/028* (2013.01); *G09G 2340/16* (2013.01); *G09G 2360/16* (2013.01)

(56) References Cited

U.S. PATENT DOCUMENTS

| | | | | |
|---|---|---|---|---|
| 2012/0057084 | A1* | 3/2012 | Sano | G09G 3/3426 348/790 |
| 2012/0086738 | A1* | 4/2012 | Shimizu | G09G 3/3426 345/690 |
| 2013/0249970 | A1 | 9/2013 | Asano et al. | |
| 2014/0092147 | A1 | 4/2014 | Kimura et al. | |
| 2014/0152721 | A1 | 6/2014 | Byun et al. | |
| 2015/0077640 | A1 | 3/2015 | Kanda | |
| 2015/0109346 | A1 | 4/2015 | Taniguchi et al. | |
| 2015/0208046 | A1 | 7/2015 | Kawaguchi | |
| 2016/0323554 | A1* | 11/2016 | Oh | H04N 7/015 |

FOREIGN PATENT DOCUMENTS

| | | | |
|---|---|---|---|
| JP | 2014-035386 | A | 2/2014 |
| JP | 2015-007739 | A | 1/2015 |
| JP | 2015-139082 | A | 7/2015 |
| JP | 2015-197605 | A | 11/2015 |
| WO | 2013/128687 | A1 | 9/2013 |

* cited by examiner

DISPLAY DEVICE, DISPLAY METHOD, RECORDING MEDIUM, AND TELEVISION RECEIVER

TECHNICAL FIELD

The present invention relates to a display method that displays an image on a display device including a display unit that is enabled to adjust luminance on a per area basis of multiple areas, a control program that causes a computer to function as the display device, a computer readable recording medium that has recorded the control program, and a television receiver that includes the display device.

BACKGROUND ART

A technique disclosed herein is to adjust luminance of an image displayed on a display device.

Patent Literature 1 describes an image processing device that performs a compression operation on luminance gradation of an input image by using at least one of a maximum value and an average value of luminance signals of the input image and by comparing at least one of the maximum value and the average value with a saturation level, serving as a reference. The saturation level is obtained by accumulating light for a predetermined period of time in the case that the input image is captured.

Patent Literature 2 describes a light emitting device that controls an amount of light emitted by a light emitter in response to values from a luminance sensor and a temperature sensor. The light emitter includes multiple control blocks that are independently enabled to control light emission.

CITATION LIST

Patent Literature

PTL 1: Japanese Unexamined Patent Application Publication No. 2015-139082 (published Jul. 30, 2015)

PTL 2: Japanese Unexamined Patent Application Publication No. 2015-197605 (published Nov. 9, 2015)

SUMMARY OF INVENTION

Technical Problem

The technique disclosed in PTL 1 may control degradation of images but may not possibly display an image having appropriate luminance (such as a high-contrast image). The technique disclosed in PTL 2 may display an image of appropriate luminance, but has a complex configuration because a luminance sensor and a temperature sensor need to be used.

The present invention has been developed in view of these problems, and the object thereof is to provide a technique that displays an image at appropriate luminance using a configuration simpler than those of the related art.

Solution to Problem

According to an aspect of the present invention, there is provided a display device that solves the above-described problems. The display device includes a display unit, an image processing unit, a display control unit, and a process information generation unit. The display unit is partitioned into multiple areas, and is configured such that luminance of an image to be displayed is adjustable on a per area basis of the areas. The image processing unit generates an output image by modifying a signal level of an input image. The display control unit determines outputtable maximum luminance in response to the output image, adjusts luminance on a per area basis of the areas in response to the output image and the maximum luminance, and displays the output image on the display unit at the adjusted luminance. The process information generation unit generates process information responsive to the maximum luminance and luminance at which the display unit is enabled to display. The image processing unit generates the output image by modifying the signal level of the input image in a current frame by referencing the process information concerning a preceding frame generated by the process information generation unit in the preceding frame.

According to another aspect of the present invention, there is provided a display method of displaying an image on a display device including a display unit. The display method includes an image processing step, a display control step, and a process information generation step. The display unit is partitioned into multiple areas, and is configured such that luminance of an image to be displayed is adjustable on a per area basis of the areas. The image processing step includes generating an output image by modifying a signal level of an input image. The display control step includes determining outputtable maximum luminance in response to the output image, adjusting luminance on a per area basis of the areas in response to the output image and the maximum luminance, and displaying the output image on the display unit at the adjusted luminance. The process information generation step includes generating process information responsive to the maximum luminance and luminance at which the display unit is enabled to display. The image processing step includes generating the output image by modifying the signal level of the input image in a current frame by referencing the process information concerning a preceding frame generated in the process information generation step in the preceding frame.

Advantageous Effects of Invention

According to an aspect of the present invention, an image of appropriate luminance is displayed in a configuration that is simpler than those of the related art.

DESCRIPTION OF EMBODIMENTS

First Embodiment

A first embodiment of the present invention is described in detail below. In the first embodiment, a display unit includes a liquid-crystal panel and an LED backlight. The present invention is not limited to this configuration. For example, in accordance with the present invention, the display unit may include an organic electroluminescence (EL) display.

(Display Device 1)

Figure 1:
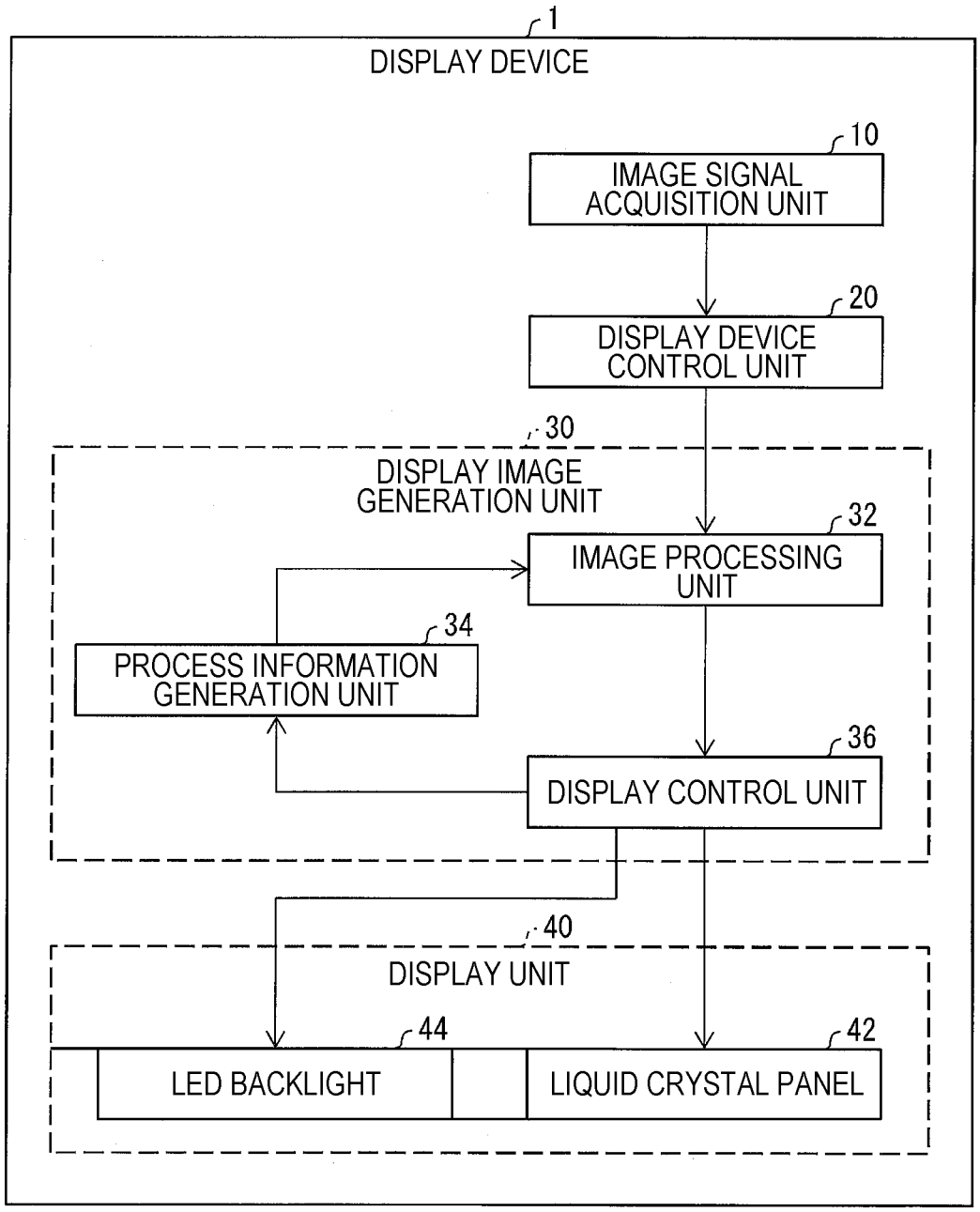
FIG. 1 is a block diagram illustrating a configuration of main elements of a display device of a first embodiment of the present invention.

FIG. 1 is a block diagram illustrating a configuration of main elements of a display device 1 of a first embodiment of the present invention. The display device 1 includes a display unit that is enabled to adjust luminance on a per area basis of multiple areas (in other words, the display device 1 has local dimming functionality). Referring to FIG. 1, the display device 1 includes an image signal acquisition unit 10, a display device control unit 20, a display image generation unit 30, and a display unit 40.

The image signal acquisition unit 10 acquires an image signal. An example of the image signal acquired by the image signal acquisition unit 10 includes a tuner signal acquired via a tuner, a high-definition multimedia interface (HDMI (registered trademark)) signal acquired via HDMI, or a composite video, blanking, and sync (CVBS) signal.

The display device control unit 20 generally controls each element of the display device 1 and is implemented by a central processing unit (CPU).

The display unit 40 is a device that displays an image, and includes a liquid crystal panel 42 and an LED backlight 44.

The liquid crystal panel 42 is a display device that displays an output image.

The LED backlight 44 includes multiple LED elements, and the multiple LED elements emit light onto the back surface of the liquid crystal panel 42.

The display image generation unit 30 generates an output image to be displayed. The display image generation unit 30 displays the generated output image by controlling the liquid crystal panel 42 and the LED backlight 44. Referring to FIG. 1, the display image generation unit 30 also functions as an image processing unit 32, a process information generation unit 34, and a display control unit 36.

The image processing unit 32 modifies the signal level of an input image by referencing process information.

The process information generation unit 34 acquires information from the display control unit 36, and generates process information in response to the information and maximum display luminance at which the display unit 40 is able to display. The "maximum display luminance at which the display unit 40 is able to display" is naturally determined by the characteristics of the display unit 40, and is not a value that changes in response to an image displayed.

The display control unit 36 (1) determines outputtable maximum luminance responsive to the output signal, (2) adjusts the luminance on a per area basis of the multiple areas of the LED backlight 44 in response to the output signal and the maximum luminance, and (3) displays the output signal on the display unit 40 at the adjusted luminance. The "outputtable maximum luminance responsive to the output signal" is configured in the case that panel is controlled from the standpoint of power consumption and heat, and is different depending on an image displayed. The "outputtable maximum luminance responsive to the output signal" is described below with reference to FIG. 5.

(External View of Display Device 1)

Figure 2:
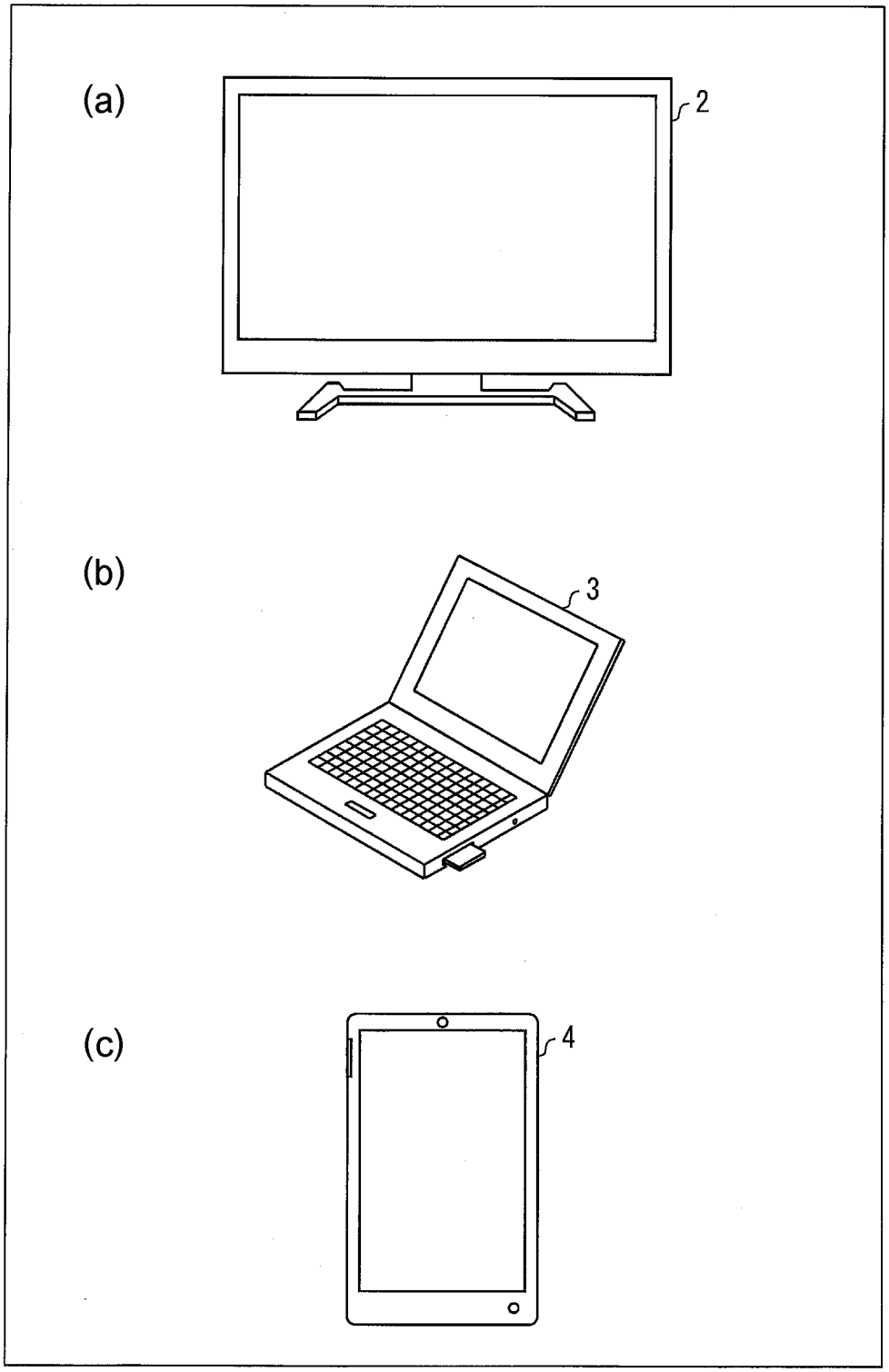
FIG. 2 is an external view of a television receiver, a personal computer, and a portable information terminal device, each including the display device of the first embodiment of the present invention.

FIG. 2 is an external view of a television receiver 2, a personal computer 3, and a portable information terminal device 4, each including the display device 1 of the first embodiment of the present invention. Referring to FIG. 2, the display device 1 is implemented as part of the television receiver (FIG. 2(*a*)), the personal computer (FIG. 2(*b*)), or the portable information terminal device (FIG. 2(*c*)), but is not limited to these devices.

(Process of Display Device 1)

Figure 3:
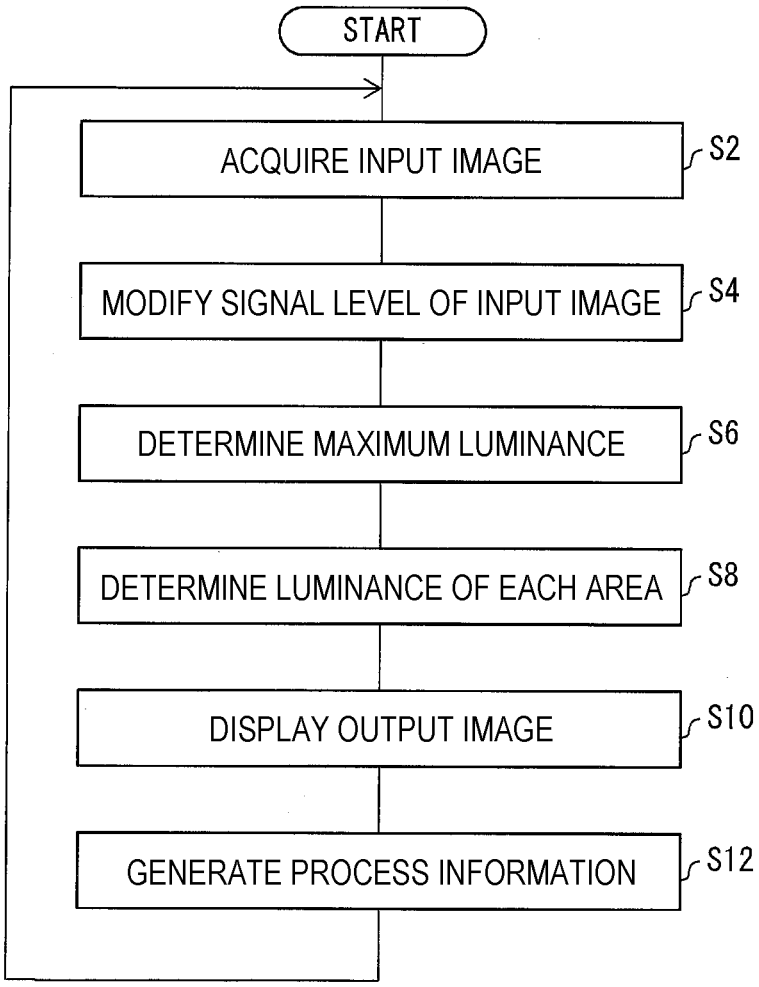
FIG. 3 is a flowchart illustrating a process to be performed by the display device of the first embodiment of the present invention.

FIG. 3 is a flowchart illustrating a process to be performed by the display device 1 of the first embodiment of the present invention (a display method to display an image on the display device 1). The process to be performed by the display device 1 is described with reference to FIG. 3. It is notable that the display device 1 is configured to perform the process illustrated in the flowchart of FIG. 3 on a per frame basis.

(Step S2)

The display device control unit 20 acquires the input signal via the image signal acquisition unit 10. The display device control unit 20 outputs the acquired input signal to the display image generation unit 30. The image processing unit 32 in the display image generation unit 30 acquires the input signal output from the display device control unit 20.

(Step S4: Image Processing Step)

The image processing unit 32 modifies the signal level of the input image by referencing the process information generated by the process information generation unit 34. The image processing unit 32 may reference the process information once every several frames. If the image processing unit 32 does not reference the process information, the image processing unit 32 modifies the signal level of the input image in accordance with information concerning a preceding frame value. The process of the process information generation unit 34 to generate the process information in step S12 is described in detail below with reference to related figures.

Figure 4:
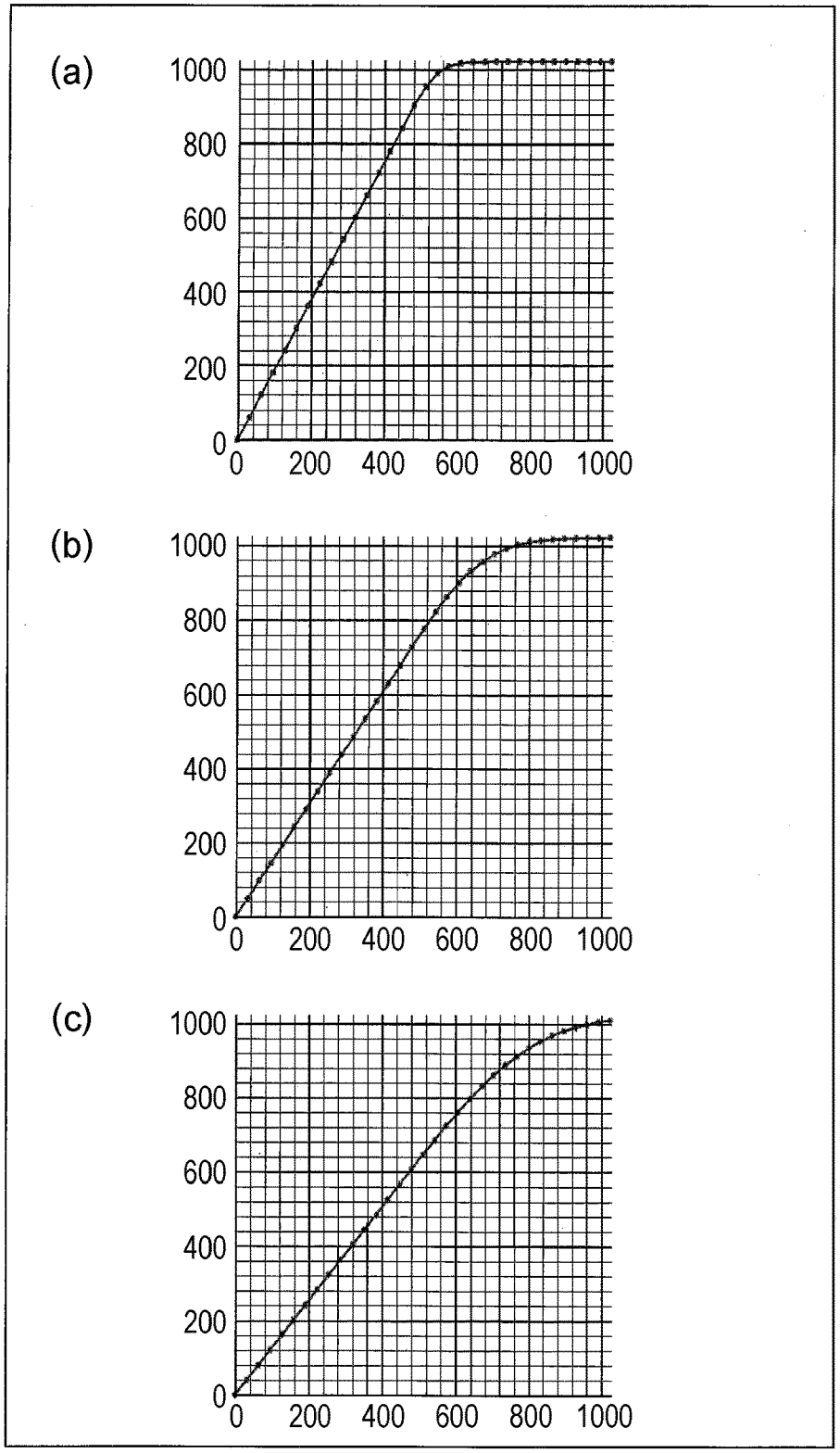
FIG. 4(*a*) through FIG. 4(*c*) are graphs illustrating relationships between an input signal level and an output signal level in accordance with the first embodiment of the present invention, wherein FIG. 4(*a*) illustrates an example of a graph, FIG. 4(*b*) illustrates an example of another graph, and FIG. 4(*c*) illustrates an example of another graph.

An example of the signal level modified by the image processing unit 32 is described with reference to FIG. 4(*a*) through FIG. 4(*c*). FIG. 4(*a*) through FIG. 4(*c*) are graphs illustrating relationships between an input signal level and an output signal level in accordance with the first embodiment of the present invention. FIG. 4(*a*) illustrates an example of a graph, FIG. 4(*b*) illustrates an example of another graph, and FIG. 4(*c*) illustrates an example of another graph.

By referencing the process information, the image processing unit 32 modifies the input signal level such that the output signal levels illustrated in the graphs of FIG. 4(*a*) through FIG. 4(*c*) are obtained. In other words, referring to FIG. 4(*a*) through FIG. 4(*c*), the process information indicates gain of an output signal to an input signal (gradient illustrated in FIG. 4). The image processing unit 32 modifies the level of the input signal such that the gain indicated by the process information is obtained.

The image processing unit 32 outputs an image with the signal level thereof modified as an output image to the display control unit 36.

(Step S6: Display Control Step)

Figure 5:
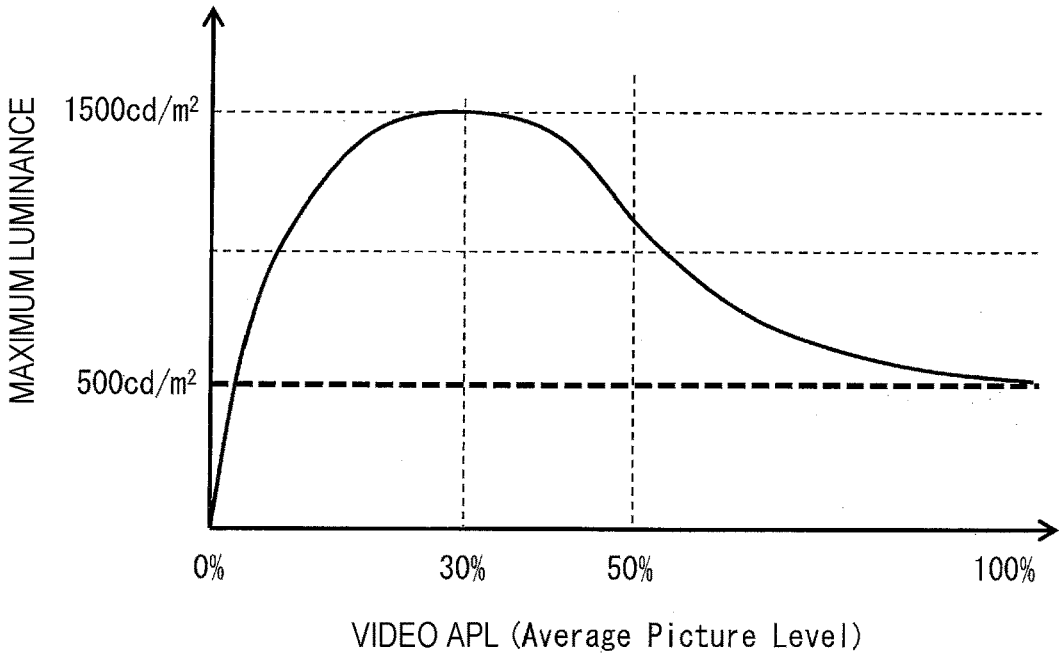
FIG. 5 illustrates an example of a graph that is referenced in the case that a display control unit of the first embodiment of the present invention determines maximum luminance.

Upon acquiring the output image, the display control unit 36 determines maximum luminance by referencing the output image. The display control unit 36 may reference the output image once every several frames. If the display control unit 36 does not reference the output image, the display control unit 36 determines the maximum luminance in accordance with information concerning a preceding frame value. FIG. 5 illustrates an example of a graph that the display control unit 36 references to determine the maximum luminance. FIG. 5 illustrates an example of the graph that the display control unit 36 of the first embodiment of the present invention references in the case that the display control unit 36 determines the maximum luminance.

Referring to FIG. 5, the maximum luminance at which the display unit 40 is enabled to display varies depending on an image to be displayed. For example, if APL is 100%, the maximum luminance at which the display unit 40 is enabled to display is about 500 cd/m$^2$, and if APL is 30%, the maximum luminance at which the display unit 40 is enabled to display is about 1500 cd/m$^2$. From the standpoint of power consumption and heat of the display unit 40, it is not possible to display all areas at high luminance.

In step S6, the display control unit 36 determines the maximum luminance by referencing the graph of FIG. 5. To this end, the display control unit 36 calculates first an average picture level (APL) that is an average value of brightness of pixels of an acquired output image. The display control unit 36 determines the maximum luminance corresponding to the calculated APL in accordance with the graph of FIG. 5. For example, if APL is 100%, the display control unit 36 determines the maximum luminance to be 500 cd/m$^2$. If APL is 30%, the display control unit 36 determines the maximum luminance to be 1500 cd/m$^2$.

(Step S8: Display Control Step)

The display control unit 36 determines luminance of each area. More specifically, the display control unit 36 determines luminance of each area such that the output image is higher in contrast. To this end, the display control unit 36 determines the luminance of each area to cause a bright area in the output image to be brighter, and a dark area in the output image to be darker.

(Step S10: Display Control Step)

The display control unit 36 controls the LED backlight 44 such that the luminance of each area determined in step S8 is obtained, and displays on the liquid crystal panel 42 the output image obtained in step S6.

(Step S12: Process Information Generation Step)

The process information generation unit 34 acquires information from the display control unit 36, thereby generating the process information. The process information generation unit 34 may acquire the information once every several frames. If the process information generation unit 34 does not acquire the information, the process information generation unit 34 generates the process information in accordance with information concerning a preceding frame. The process the process information generation unit 34 to generate the process information is described below in detail.

(Process of Process Information Generation Unit 34)

Figure 6:
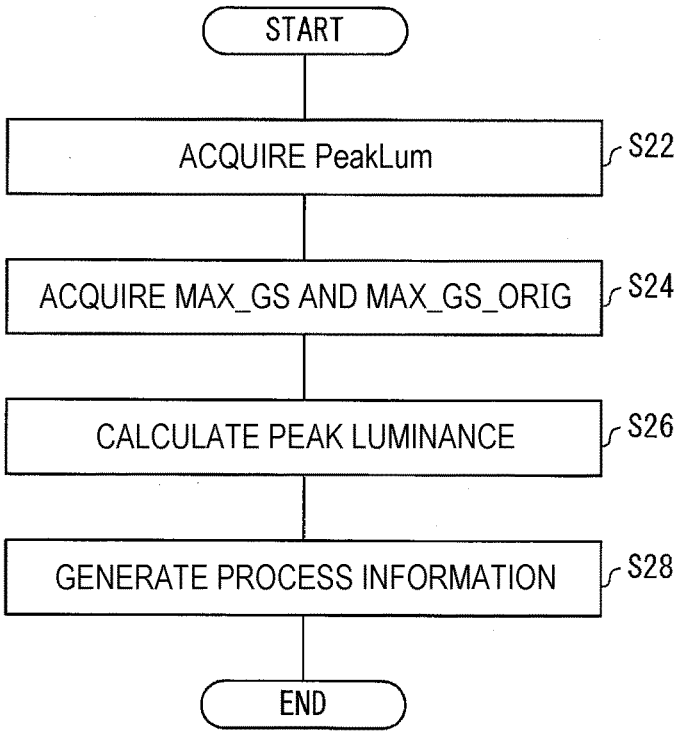
FIG. 6 is a flowchart illustrating a process of a process information generation unit of the first embodiment of the present invention that generates process information.

FIG. 6 is a flowchart illustrating a process of the process information generation unit 34 of the first embodiment of the present invention that generates the process information. The process of the process information generation unit to generate the process information is described with reference to FIG. 6.

(Step S22)

The process information generation unit 34 acquires PeakLum that is information indicating maximum display luminance as luminance at which the display unit 40 is enabled to display. A value responsive to the display unit 40 is stored as PeakLum on a memory (not illustrated), and the process information generation unit 34 acquires PeakLum from the memory.

(Step S24)

The process information generation unit 34 acquires from the display control unit 36 MAX_GS_ORIG and MAX_GS. Here, MAX_GS_ORIG is a normalized value of outputtable luminance. MAX_GS is a value indicating a ratio of the maximum luminance determined in step S6 to MAX_GS_ORIG. For example, if, as illustrated in FIG. 5, maximum luminance at which the display control unit 36 is enabled to display the output image is 1500 cd/m$^2$ and maximum luminance determined in step S6 is 750 cd/m$^2$, MAX_GS_ORIG=1 and MAX_GS=0.5.

MAX_GS_ORIG may not necessarily be 1. The display control unit 36 may limit the maximum luminance of the output more than the characteristics illustrated in FIG. 5. In such a case, if highest luminance at which the output image displayable is displayed and the maximum luminance are 450 cd/m$^2$, MAX GS ORIG=0.3, and MAX_GS=0.3. The process information generation unit 34 may acquire the average luminance of the output rather than the maximum luminance of the output, or may acquire both the average luminance of the output and the maximum luminance of the output.

(Step S26)

The process information generation unit 34 calculates peak luminance (PeakW) in accordance with the following formula.

$$\text{PeakW}=\text{PeakLum}\cdot\text{MAX GS}/\text{MAX_GS_ORIG}$$

For example, if PeakLum=1500 cd/m$^2$, MAX_GS=0.5, and MAX GS ORIG=1, PeakW is 1500·0.5/1=750 cd/m$^2$. If MAX GS ORIG=1, the process information generation unit 34 may reference only the value of MAX GS. In other words, the process information generation unit 34 references outputtable luminance (MAX GS/MAX_GS_ORIG), and generates the process information responsive to the outputtable luminance and PeakLum.

(Step S28)

The process information generation unit 34 generates the process information in response to the calculated peak luminance. For example, if the calculated peak luminance is 500 cd/m$^2$, the process information generation unit 34 generates the process information such that the relationship between the input signal and the output signal is as illustrated in FIG. 4(*a*). For example, if the calculated peak luminance is 1000 cd/m$^2$, the process information generation unit 34 generates the process information such that the relationship between the input signal and the output signal is as illustrated in FIG. 4(*b*). For example, if the calculated peak luminance is 1200 cd/m$^2$, the process information generation unit 34 generates the process information such that the relationship between the input signal and the output signal is as illustrated in FIG. 4(*c*).

In other words, as the calculated peak luminance becomes lower, the process information generation unit 34 configures the gain of output signal to the input signal (gradient of the graph of FIG. 4) to be a larger value. Also, as the calculate peak luminance becomes higher, the process information generation unit 34 configures the gain of output signal to the input signal (gradient of the graph of FIG. 4) to be a smaller value.

The process information generation unit 34 outputs the generated process information to the image processing unit 32, and processing to be performed by the display device 1 returns to step S2. In step S4, the image processing unit 32 references the acquired process information, and modifies the signal level of the input image. In other words, with respect to the input image with the signal level thereof to be modified, the image processing unit 32 modifies the signal level of the input image in the current frame by referencing the process information in a preceding frame generated by the process information generation unit in the preceding frame.

In this way, the display device 1 of the first embodiment includes the display unit 40, the image processing unit 32, and the display control unit 36. The display unit 40 is partitioned into multiple areas, and is configured such that luminance of an image to be displayed is adjustable on a per area basis of the multiple areas. Also, the image processing unit 32 modifies the signal level of the input image. In response to the output image, the display control unit 36 determines the maximum luminance outputtable, adjusts luminance on a per area basis of the multiple areas in response to the output image and the maximum luminance, and displays the output image on the display unit 40 at the adjusted luminance.

In that configuration, the display device 1 modifies the signal level of the input image to a higher level (a lower level) even if the maximum luminance that the display control unit 36 has determined for the image in the current frame is lower (higher) than the maximum luminance that the display control unit 36 has determined for the image in the preceding frame. For this reason, even if the display control unit 36 configures different maximum luminance values for the images in the current frame and the preceding frame, the display device 1 is enabled to display an image having a smaller difference between luminance values. The display device 1 thus displays an image of appropriate luminance. Without using a sensor or the like, the display device 1 may display an image of appropriate luminance with a configuration simpler than those of the related art.

The display device 1 includes the display unit 40 that includes the LED backlight 44 that is enabled to adjust luminance on a per area basis of the multiple areas. The display control unit 36 adjusts the luminance on a per area basis of the multiple areas by controlling the LED backlight 44. In that configuration, the display unit 40 adjusts the luminance appropriately and the display device 1 then displays an image of appropriate luminance.

The display device 1 includes the process information generation unit 34 that generates the process information in response to the maximum luminance determined by the display control unit 36 and the luminance at which the display unit 40 is enabled to display. The image processing unit 32 generates the output image by modifying the signal level of the input image in the current frame by referencing the process information related to the preceding frame generated by the process information generation unit 34 in the preceding frame. In that configuration, the display device 1 generates the output image in a feedback operation. The display device 1 may thus display an image of appropriate luminance in view of the difference between the images in the preceding frame and the current frame.

If information concerning luminance is included in the input image (such as in a high dynamic range (HDR) signal), the display device 1 may display an image of more appropriate luminance. More specifically, the display device control unit 20 converts the information included in the input image into information concerning luminance in the display device 1 (for example, converts information of PQ curve into a gamma curve). By performing the process described above, the display device 1 may display an image of more appropriate luminance even if the information concerning luminance is included in the input image.

Figure 8:
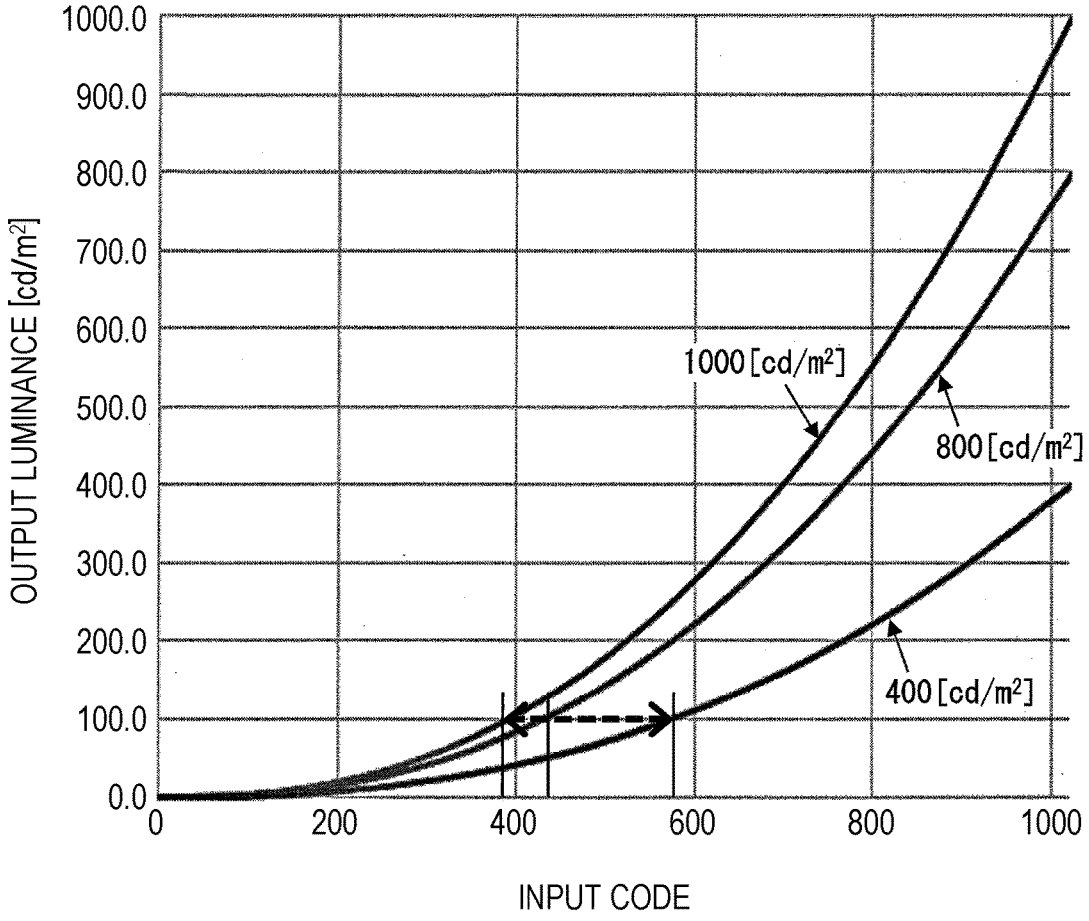
FIG. 8 is a graph illustrating gamma curves.

FIG. 8 is a graph illustrating a gamma curve. Referring to FIG. 8, the gamma curve of the display unit 40 may change in response to the display luminance characteristics of the display through maximum luminance control of FIG. 5. For this reason, in order to specify the same output luminance (for example, 100 cd/m$^2$), an input code to the display control unit 36 needs to be changed in response to the display luminance characteristics. Referring to FIG. 4, the display device 1 may display an image of more appropriate luminance by adjusting the gain of the output signal to the input signal.

Second Embodiment

A second embodiment of the present invention is described with reference to FIG. 7. For convenience of explanation, elements identical to those described with reference to the first embodiment are designated with the same reference numerals and the discussion thereof is omitted herein. In accordance with the second embodiment, the display device 1 restricts oscillation of luminance through a feedback operation.

Figure 7:
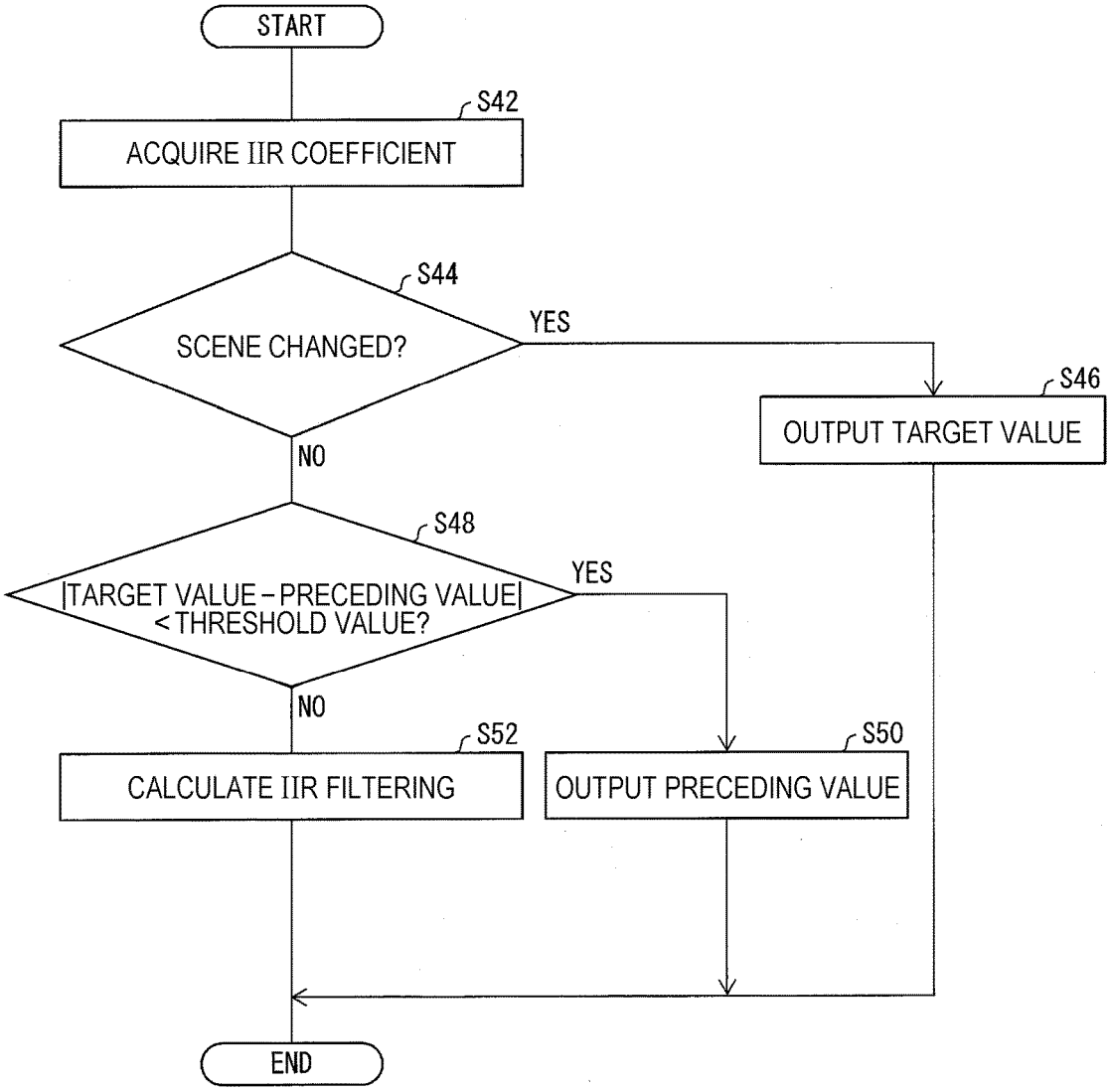
FIG. 7 is a flowchart illustrating a process of a process information generation unit of a second embodiment of the present invention that controls luminance oscillation.

FIG. 7 is a flowchart illustrating a process of a process information generation unit (luminance oscillation restricting unit) 34 of the second embodiment of the present invention that controls luminance oscillation. The process of FIG. 7 is to be performed subsequent to step S28 of the flowchart of FIG. 6. In the following discussion, a "target value" is a gain value that the image processing unit 32 has calculated in the process on the current frame. A "previous value" is a gain value that the image processing unit 32 has calculated in the process on the preceding frame.

(Step S42)

The process information generation unit 34 acquires an IIR coefficient from a memory (not illustrated). The IIR coefficient relates to an infinite impulse response (IIR) filter, and indicates how much the image processing unit 32 modifies the input signal (how much the image processing unit 32 modifies the gain). More specifically, if the image processing unit 32 excessively modifies the input signal, the luminance of the displayed output image varies unnaturally. In order to naturally vary the luminance of the displayed output image, the process information generation unit 34 is preferably configured such that the process information generation unit 34 outputs to the image processing unit 32 in the current frame a value that gradually varies from a preceding value to a target value instead of directly outputting the target value to the image processing unit 32. In that configuration, the filter that the process information generation unit 34 uses to calculate a value varying from the preceding value to the target value is the IIR filter.

(Step S44)

The process information generation unit 34 determines whether the output image in the current frame output from the display control unit 36 is an image scene-changed from the image in the preceding frame. In a specific determination method available to determine whether the image is scene-changed, APL of the image in the current frame is compared with APL of the image in the preceding frame and if the difference therebetween is larger than a threshold value, the image is determined to be scene-changed. In another determination method available to determine whether the image is scene-changed, luminance histogram information of the image in the current frame is compared with luminance histogram information of the image in the preceding frame, and if the difference therebetween is larger, the image is determined to be scene-changed.

(Step S46)

If the image is determined to be "scene-changed" in step S44 (yes from step S44), the process information generation unit 34 outputs the target value as the process information to the image processing unit 32. More specifically, if the image has been scene-changed, the process information generation unit 34 outputs to the image processing unit 32 the gain corresponding to the scene-changed image if the image has been scene-changed.

(Step S48)

If the image is determined to be "not scene-changed" (no from step S44), the process information generation unit 34 determines whether the absolute value of a difference between the target value and the preceding value is smaller than a threshold value.

(Step S50)

If the process information generation unit 34 has determined that "the absolute value of the difference between the target value and the preceding value is smaller than the threshold value" (yes from step S48), the process information generation unit 34 outputs the preceding value as the process information to the image processing unit 32. More specifically, if the absolute value of the difference between the target value and the preceding value is smaller than the threshold value (in other words, a difference between the image in the current frame and the image in the preceding frame is smaller), the process information generation unit 34 outputs to the image processing unit 32 the gain calculated in the process of the preceding frame instead of the gain calculated in the process of the current frame.

(Step S52)

If the process information generation unit 34 has determined that "the absolute value of the difference between the target value and the preceding value is not smaller than the threshold value" (no from step S48), the process information generation unit 34 performs IIR filtering calculation. More in detail, the process information generation unit 34 calculates the gain value in the current frame using an IIR filter. It is notable that the process information generation unit 34 may calculate an amount of change between the target value and the preceding value, and may calculate the IIR coefficient in response to the amount of change.

In this way, the display device 1 of the second embodiment includes the process information generation unit 34 that generates the process information, based on the maximum luminance determined by the display control unit 36 and the luminance at which the display unit 40 is enabled to display. The display device 1 selects, as the process information that the image processing unit 32 references to generate the output image, the process information concerning the current fame or the process information concerning the preceding frame. If in that configuration, the difference between the gain calculated in the current frame and the gain calculated in the preceding frame is smaller, the display device 1 selects as the process information the gain calculated in the preceding frame, and thus controls the oscillation of luminance.

In the configuration described above, the process information generation unit 34 performs the process of FIG. 7 (in other words, in the configuration implemented using software). Alternatively, the process of FIG. 7 may be implemented using hardware.

(Implementation Examples by Software)

A control block (the display image generation unit 30 in particular) in the display device 1 may be implemented with a logic circuit (hardware) formed on an integrated circuit (IC chip) or the like, or may be implemented with software by using a central processing unit (CPU).

In the latter case, the display device 1 includes a CPU that executes the control program that is software implementing each functionality, a read only memory (ROM) or a storage device (these are referred to as "recording media") that has recorded the control program and a variety of data in a computer-readable fashion, and a random access memory (RAM) that expands the control program. The object of the present invention is thus accomplished by a computer (or the CPU) that reads the control program from the recording medium and executes the read control program. The recording media may include a "non-transitory and tangible medium", such as a tape, a disk, a card, a semiconductor memory, or a logic circuit that is programmable. The control program may be delivered to the computer via any transmission media (such as a communication network or radio-broadcasting wave) that carries the control program. The present invention may be embodied by electronic transmission of the control program, for example, in the form of a data signal that is embedded in a carrier wave.

CONCLUSION

According to a first aspect of the present invention, the display device 1 includes the display unit 40, the image processing unit 32, and the display control unit 36. The display unit is partitioned into multiple areas, and is configured such that luminance of an image to be displayed is adjustable on a per area basis of the multiple areas. The image processing unit generates the output image by modifying the signal level of the input image. The display control unit determines the outputtable maximum luminance in response to the output image, adjusts luminance on a per area basis of the multiple areas in response to the output image and the maximum luminance, and displays the output image on the display unit at the adjusted luminance.

In that configuration, the display device of the first aspect modifies the signal level of the input image to a higher level (a lower level) even if the maximum luminance that is determined for the image in the current frame is lower (higher) than the maximum luminance that is determined for the image in the preceding frame. For this reason, even if different maximum luminance values are configured to be the images in the current frame and the preceding frame, the display device is enabled to display an image having a smaller difference between luminance values. The display device thus displays an image of appropriate luminance. Without using a sensor or the like, the display device may display an image of appropriate luminance with a configuration simpler than those of the related art.

According to a second aspect of the present invention, in view of the first aspect, the display device may further include the luminance oscillation restricting unit (the process information generation unit 34) that selects, as the process information that the image processing unit references to generate the output image, the process information concerning the current frame or the process information concerning the preceding frame.

In that configuration, the display device of the second aspect restricts the oscillation of luminance by selecting the process information of the preceding frame if the difference between the information concerning the current frame and the information concerning the preceding frame is smaller.

According to a third aspect of the present invention, in the display device of one of the first and second aspects, the display unit may include the backlight that is enabled to adjust luminance on a per area basis of the multiple areas, and the display control unit may adjust the luminance on a per area basis by controlling the backlight.

In that configuration, the display device of the third aspect appropriately adjusts the luminance of the display unit.

According to a fourth aspect of the present invention, the display device of one of the first through third aspects may further include the process information generation unit that generates the process information responsive to the maximum luminance and the luminance at which the display unit is enabled to display. The image processing unit generates the output image by modifying the signal level of the input image in the current frame by referencing the process information concerning the preceding frame generated by the process information generation unit in the preceding frame.

In that configuration, the display device of the fourth aspect generates the output image in accordance with the feedback operation, and thus displays the image of more appropriate luminance in response to the difference between the images of the current frame and the preceding frame.

According to a fifth aspect of the present invention, there is provided the display method of displaying the image on the display device including the display unit. The display method includes the image processing step, the display control step, and the process information generation step. The display unit is partitioned into multiple areas, and is configured such that luminance of the image to be displayed is adjustable on a per area basis of the multiple areas. The image processing step includes generating the output image by modifying the signal level of the input image. The display control step includes determining the outputtable maximum luminance in response to the output image, adjusting the luminance on a per area basis of the multiple areas in response to the output image and the maximum luminance, and displaying the output image on the display unit at the adjusted luminance.

In that configuration, the display method of the fifth aspect provides the same advantageous effects as those of the display device of the first aspect.

According to a sixth aspect of the present invention, there is provided the television receiver 2. The television receiver 2 includes the display device according to one of the first through fourth aspects.

In that configuration, the television receiver of the sixth aspect provides the same advantageous effects as those of the display device according to one of the first through fourth aspect.

The display device of each aspect of the present invention may be implemented by a computer. In such a case, a control program that causes the computer to function as the display device by causing the computer to function as each element (software element) of the display device and a computer readable recording medium having recorded the control program fall within the scope of the present invention.

The present invention is not limited to the embodiments described above. A variety of modification is possible without departing from the scope of the present invention defined by the claims. An embodiment that is implemented by adequately combining technical means disclosed in the different embodiments falls within the scope of the present invention. Furthermore, a new technical feature may be formed by combining technical means disclosed in each of the embodiments.

REFERENCE SIGNS LIST

1 Display device
10 Image signal acquisition unit
20 Display device control unit
30 Display image generation unit
32 Image processing unit
34 Process information generation unit (luminance oscillation restricting unit)
36 Display control unit
40 Display unit
42 Liquid crystal panel
44 LED backlight

The invention claimed is:

1. A display device comprising:
a display;
image processing circuitry;
device control circuitry;
luminance oscillation restricting circuitry; and
process information generation circuitry, wherein
the display is partitioned into a plurality of areas, and is configured such that luminance of an image to be displayed is adjustable on a per area basis of the areas,
the image processing circuitry generates an output image by modifying a signal level of an input image,
the display control circuitry determines outputtable maximum luminance in response to the output image, adjusts luminance on a per area basis of the areas in response to the output image and the maximum luminance, and displays the output image on the display unit at the adjusted luminance,
the process information generation circuitry generates process information responsive to the maximum luminance and luminance at which the display is enabled to display, and
the image processing circuitry generates the output image by modifying the signal level of the input image in a current frame by referencing the process information concerning a preceding frame generated by the process information generation circuitry in the preceding frame, and
the luminance oscillation restricting circuitry selects, as the process information that the image processing circuitry references to generate the output image, the process information concerning the current frame or the process information concerning the preceding frame, depending on a difference between a gain calculated in the current frame and a gain calculated in the preceding frame.

2. The display device according to claim 1, wherein
the display includes a backlight that adjusts the luminance on a per area basis of the areas, and
the display control circuitry adjusts the luminance on a per area basis of the areas by controlling the backlight.

3. A non-transitory computer readable recording medium having recorded a control program causing a computer to operate the display device according to claim 1, the control program causing the computer to perform as the image processing circuitry and the display control circuitry.

4. A television receiver comprising the display device according to claim 1.

5. A method of displaying an image on a display device including a display and a processor, the method comprising:

an image processing step;

a display control step;

a luminance oscillation restricting step; and a process information generation step, wherein the display is partitioned into a plurality of areas, and is configured such that luminance of an image to be displayed is adjustable on a per area basis of the areas, the image processing step causes the processor to generate an output image by modifying a signal level of an input image, the display control step causes the processor to:

determine outputtable maximum luminance in response to the output image, adjust luminance on a per area basis of the areas in response to the output image and the maximum luminance, and display the output image on the display at the adjusted luminance, the process information generation step includes causing the processor to process information responsive to the maximum luminance and luminance at which the display is enabled to display, the luminance oscillation restricting step includes causing the processor to select, as the process information that is referenced in the image processing step to generate the output image, the process information concerning a current frame or the process information concerning a preceding frame generated in the process information generation step in the preceding frame, depending on a difference between a gain calculated in the current frame and a gain calculated in the preceding frame, and the image processing step includes causing the processor to generate the output image by modifying the signal level of the input image in the current frame by referencing the process information selected in the luminance oscillation restricting step.

* * * * *